US005425126A

United States Patent [19]

Lee

[11] Patent Number: 5,425,126

[45] Date of Patent: Jun. 13, 1995

[54] CEILING FAN HEATER WITH HEATER HOUSING

[76] Inventor: Michael A. Lee, 210 Catherine St., Union, S.C. 29379

[21] Appl. No.: 75,617

[22] Filed: Jun. 14, 1993

[51] Int. Cl.[6] ..... F24H 9/06

[52] U.S. Cl. ..... 392/364; 392/361; 416/95; 165/121

[58] Field of Search ..... 392/364, 361; 416/95; 165/121, 122, 124–127; 126/110 B

[56] References Cited

U.S. PATENT DOCUMENTS

| | | | |
|---|---|---|---|
| D. 320,439 | 10/1991 | Harper | D23/328 |
| 2,239,848 | 4/1941 | Jackson | 165/122 |
| 2,318,393 | 5/1943 | Honerkamp et al. | 165/125 |
| 2,363,839 | 11/1944 | Demuth | 165/125 |
| 2,504,798 | 4/1950 | Brinen | 165/122 |
| 2,519,496 | 8/1950 | Norman, Jr. | 165/124 |
| 4,151,811 | 5/1979 | Truhan | 119/33 |
| 4,504,191 | 3/1985 | Brown | 416/95 |
| 4,508,958 | 4/1985 | Kan et al. | 165/122 |
| 4,782,213 | 4/1988 | Teal | 392/379 |
| 5,077,825 | 12/1991 | Monrose | 392/361 |

FOREIGN PATENT DOCUMENTS

| | | | |
|---|---|---|---|
| 61-256128 | 11/1986 | Japan | 165/125 |
| 4-268129 | 9/1992 | Japan | 165/125 |

*Primary Examiner*—John A. Jeffery

*Attorney, Agent, or Firm*—Rhodes & Ascolillo; David L. Baker; Robert A. Shack

[57] ABSTRACT

Apparatus for heating and circulating air within a room, the apparatus including a ceiling fan having fan blades, a heater housing disposed vertically above the ceiling fan, a heating element disposed within the heater housing, intake ports provided in the heater housing for transferring air from the room into the interior of the heater housing, the air intake ports being disposed vertically above the ceiling fan, and air output ports provided in the heater housing for transferring air from the interior of the heater housing into the room, the air output ports being disposed vertically below the ceiling fan and outside of the radial sweep of the fan blades.

14 Claims, 1 Drawing Sheet

CEILING FAN HEATER WITH HEATER HOUSING

BACKGROUND

1. Field of the Invention

The present invention relates to a combined ceiling fan and heating apparatus that can be used to heat the air in a room and to circulate the heated air throughout the room.

2. Description of the Related Art

U.S. Pat. No. 4,508,958 relates to a ceiling fan that includes a fan motor, within a fan motor housing, the fan motor having a stationary stator and a rotatable rotor, with one or more heating elements being positioned around the outside of the rotor.

U.S. Pat. No. 4,782,213 relates to a fan, such as a ceiling fan, the blades of which are provided with an air flow passage wherein there is mounted a heating element. Vanes are provided for deflecting air through the fan blades and over the heating elements.

U.S. Pat. No. 5,077,825 discloses a space heater mounted beneath a ceiling fan. The space heater includes a downward pointing insulated frusto-conical member about which an elongate flexible heating element is wound. The frusto-conical member protects the fan motor from heat generated by the heating element.

U.S. Pat. No. 4,504,191 relates to a ceiling fan having heating elements incorporated within the fin blades.

U.S. Design Pat. No. 320,439 discloses a design for a heater which is used with a ceiling fan.

The ceiling fan heater that is presented herein is highly efficient, since a heat shield positioned against the upper interior wall of the heater housing prevents excessive heat loss to an attic or upstairs room.

SUMMARY OF THE INVENTION

In one aspect, the invention generally features an apparatus for heating and circulating air within a room having a ceiling, the apparatus including: a ceiling fan; a heater housing disposed vertically above the ceiling fan; a heating element disposed within the heater housing; at least one intake port provided in the heater housing for transferring air from the room into the interior of the heater housing; the at least one air intake port being disposed vertically above the ceiling fan; and at least one air output port provided in the heater housing for transferring air from the interior of the heater housing into the room; the at least one air output port being disposed vertically below the ceiling fan.

Preferably, the apparatus additionally includes at least one air channel extending from the heater housing to the at least one air output port.

In another aspect, the invention generally features a ceiling fan and heating apparatus for heating and circulating air within a room having a ceiling, the ceiling fan and heating apparatus including: a heater housing for attachment to the ceiling of the room; a heating device disposed within the heater housing for heating air passing through the heater housing; a plurality of fan blades disposed vertically below the heater housing; a motor for rotating the plurality of fan blades; at least one air intake port for transferring air from within the room into the heater housing; the at least one air intake port being disposed above the plurality of fan blades; and at least one air output port for transferring air from within the heater housing into the room; the at least one air output port being disposed vertically below the plurality of fan blades.

Preferably, the ceiling fan and heating apparatus additionally includes a first heat shield for protecting the heater housing from heat produced by the heating device; and a second heat shield for protecting the ceiling of the room from heat produced by the heating device; the first heat shield includes a first layer of a heat resistant material disposed on the heater housing adjacent the plurality of fan blades; the second heat shield includes a second layer of a heat resistant material disposed on the heater housing adjacent the ceiling of the room; the at least one air output port includes at least four air output ports, the at least four air output ports being spaced about the heater housing, and each of the at least four air output ports including an air output channel extending substantially vertically downward from the heater housing to a point substantially vertically below and substantially radially outside of the sweep of the plurality of fan blades; the at least four air output ports are spaced equally about the heater housing; the heater housing is, in plan view, of substantially rectangular shape, and the at least four air output ports are disposed at the four corners of the rectangular shape; the heater housing is, in plan view, of substantially square shape; the first heat shield is disposed on an exterior surface of the heater housing; the second heat shield is disposed on an interior surface of the heater housing;the heating device includes an electrical resistance heating element; the heater housing has an upper interior surface and a lower interior surface, the second heat shield being mounted on the upper interior surface of the heater housing, the electrical resistance heating element being disposed adjacent the upper interior surface of the heater housing and the second heat shield, and the electrical resistance heating element being spaced vertically from the lower interior surface of the heater housing to create a heated air flow passage therebetween, the at least one air intake port and the at least four air output ports being in communication with the heated air flow passage; the apparatus additionally includes a fan shaft for rotating the plurality of fin blades, and the at least one air intake port comprises a plurality of air intake openings arranged about the fan shaft.

In a further aspect, the invention generally features an apparatus for heating and circulating air within a room having a ceiling, the apparatus including: a ceiling fin, the ceiling fin including: a plurality of fan blades; a motor for rotating the plurality of fan blades; and a pedestal for suspending the plurality of fan blades and the motor from the ceiling such that a vertical gap exists between the ceiling and the plurality of fan blades and the motor; a heater housing disposed within the vertical gap; the heater housing having an upper wall and a lower wall; the upper wall of the heater housing being mounted against the ceiling; a heat resistant shield positioned within the heater housing and against an interior surface of the upper wall of the heater housing; an electrical resistance heater element disposed within the heater housing and adjacent the heat resistant shield; the electrical resistance element being spaced vertically from the lower wall of the heater housing to create a heated air flow passage therebetween; an additional heat resistant shield positioned outside of the heater housing and against an exterior surface of the lower wall of the heater housing; the additional heat resistant shield substantially encircling the pedestal; a plurality of air intake ports passing through the lower wall of the heater housing and from the room into the heated air flow passage; the plurality of air intake ports being positioned vertically above and radially within the sweep of the plurality of fan blades; and a plurality of air output ports passing through the heater housing and from the heated air flow passage into the room; the plurality of air output ports being positioned vertically below and radially outside of the sweep of the plurality of fan blades.

Preferably, the apparatus additionally includes a plurality of air output channels for directing heated air from the heated air passage to the plurality of air output ports, one each of the air output channels extending from the interior of the heater housing to one each of the air output ports.

One object of the present invention is the provision of a ceiling fan and heating device that will efficiently circulate heated air throughout a room or area.

Another object is the provision of a ceiling fan and heating device that can be advantageously used to augment a central heating system in a remote area of a house, or can be used to exclusively heat a selected area, while the remainder of the house is maintained at a lower temperature to conserve energy.

A still further object is the provision of such an apparatus that is very efficient in its energy usage for the heating action that it provides.

The invention will now be described by Way of a particularly preferred embodiment, reference being made to the accompanying drawings, wherein:

DESCRIPTION OF THE PREFERRED EMBODIMENT

Figure 1:
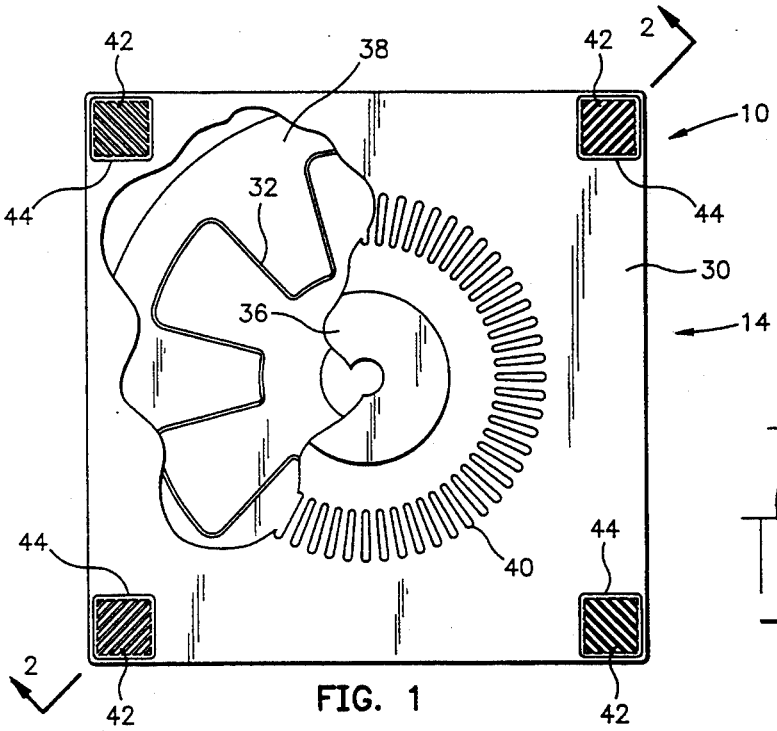
FIG. 1 is a bottom partially cut away plan view, looking upward, of a ceiling fan heater constructed according to the invention.

Referring now to all of FIGS. 1–4, a ceiling fan heater 10 constructed according to the invention generally includes a ceiling fan component 12 and a heater housing 14. The ceiling fan component 12 is of more or less conventional design and includes a plurality of radially extending fan blades 16. The ceiling fan component 12 also includes a fan motor housing 18 that encloses a fan motor for driving the rotation of the fan blades 16, as is well understood by those skilled in the art. The fan motor housing 18 may be provided with vents 20 for providing cooling air to the fan motor.

The ceiling fan heater 10 is designed for the heating of a room 22 that has a ceiling 24 from which the apparatus is to be suspended. To this end, the ceiling fan heater 10 also includes a downward projecting pedestal mount 26. The pedestal mount 26 spaces the fan motor housing 18 and the fan blades 16 downward from the ceiling 24 and thus affords sufficient space for the heater housing 14 to be positioned therebetween.

Figure 4:
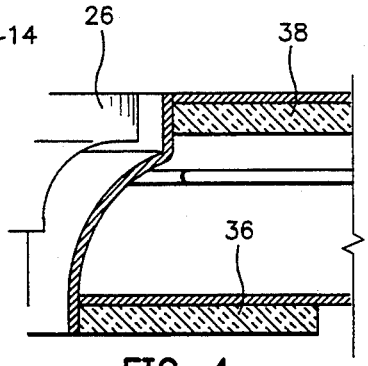
FIG. 4 is partial, cross-sectional view projected from FIG. 2 to better show the hatching for the heat shields to denote the insulative materials used.
Figure 2:
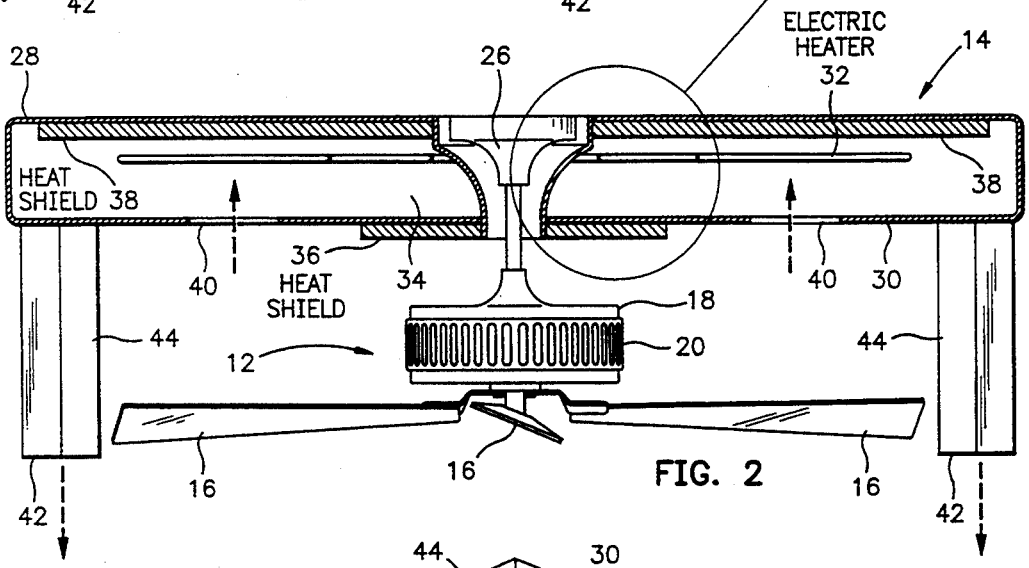
FIG. 2 is a partially sectional elevational view of the inventive ceiling fan heater.
Figure 3:
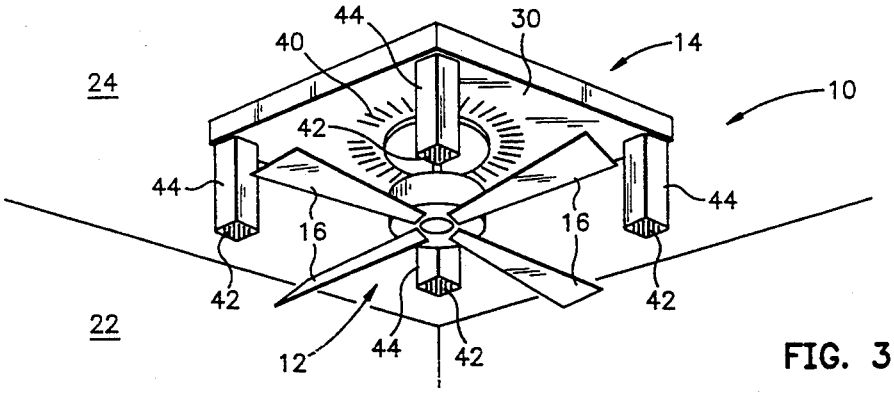
FIG. 3 is a bottom perspective view of the inventive ceiling fan heater.

The heater housing 14 is, when viewed in plan, of generally rectangular shape, and, preferably, of generally square shape, as shown in the drawings. Preferably, the heater housing 14 is constructed of sheet material, for example, sheet steel. However, other shapes (e.g., cylindrical) and other materials could be used. Preferably, the ceiling fan and heating apparatus 10 additionally includes a first heat shield 36 for protecting the lower wall 30 from heat produced by the heating device 32; and a second heat shield 38 for protecting the ceiling 24 of the room from heat produced by the heating device 32; the first heat shield 36 includes a first layer of a heat resistant material as shown in FIG. 4 disposed on the heater housing adjacent the plurality of fan blades 16; the second heat shield 38 includes a second layer of a heat resistant material as shown in FIG. 4 disposed on the heater housing adjacent the ceiling of the room.

The heater housing 14 has an upper wall 28 and a lower wall 30, and encloses a heater element 32. The heater element 32 is positioned such that it is generally nearer to the upper wall 28 and is spaced vertically away from the lower wall 30, thereby creating a passageway 34. A first heat shield 36 is mounted on and covers the central exterior surface of the lower wall 30 of the heater housing 14. Additionally, a second additional heat shield 38 is provided above the heating element 32 on the interior surface of the upper wall 28 of the heater housing 14 and serves to protect the ceiling 24.

Air intake ports 40, which are located vertically above the fan blades 16, and which pass through the lower wall 30, admit, into the interior of the heater housing 14, air which is urged upward by the rotating fan blades 16. The admitted air is warmed by the heater element 32 and reenters the room 22 through air output ports 42. The air output ports 42 are positioned such that they are vertically below and radially outward of the fan blades 16. To this end, output air channels or conduits 44 extend downward from the heater housing 14 and terminate in the air output ports 42 at a point beneath and outside the ambit of travel (or radial sweep) of the fan blades 16. In the preferred embodiment shown, where the heater housing 14 is of generally rectangular shape, one air output port 42 and its associated air output channel or conduit 44 is located at each corner of the heater housing 14.

While the invention has been herein described by way of a particular preferred embodiment, various substitutions of equivalents may be effected without departing from the spirit and scope of the invention as set forth in the following claims.

For example, while the inventive ceiling fan heater has been shown as having air output channels or conduits 44 extending downward from the heater housing, it will be understood that other configurations are possible. In this regard, rather than having four separate and discrete air output channels 44 extend downward, the heater housing can be constructed such that it incorporates a downward extending annular channel surrounding and extending to a point beneath the fan blades 16 for the output of the heated air therefrom.

What is claimed is:

1. A ceiling fan and heating apparatus for heating and circulating air within a room having a ceiling, said ceiling fan and heating apparatus comprising:

a heater housing for attachment to the ceiling of the room;

heating means disposed within said heater housing for heating air passing through said heater housing;

a plurality of fan blades disposed vertically below said heater housing;

motor means for rotating said plurality of fan blades;

at least one air intake port for transferring air from within the room into said heater housing;

said at least one air intake port being disposed above said plurality of fan blades;

at least one air output port for transferring air from within said heater housing into the room;

said at least one air output port being disposed vertically below said plurality of fan blades;

a first heat shield means for protecting said heater housing from heat produced by said heating means;

a second heat shield means for protecting the ceiling of the room from heat produced by said heating means; and said first heat shield means comprises a first layer of a heat resistant material disposed on said heater housing adjacent said plurality of fan blades.

2. A ceiling fan and heating apparatus according to claim 1, wherein said second heat shield means comprises a second layer of a heat resistant material disposed on said heater housing adjacent the ceiling of the room.

3. A ceiling fan and heating apparatus according to claim 2, wherein said at least one air output port comprises at least four air output ports, said at least four air output ports being spaced about said heater housing, and each of said at least four air output ports comprising an air output channel extending substantially vertically downward from said heater housing to a point substantially vertically below and substantially radially outside of the sweep of said plurality of fan blades.

4. A ceiling fan and heating apparatus according to claim 3, wherein said at least four air output ports are spaced equally about said heater housing.

5. A ceiling fan and heating apparatus according to claim 4, wherein said heater housing is, in plan view, of substantially rectangular shape, and wherein said at least four air output ports are disposed at the four corners of said rectangular shape.

6. A ceiling fan and heating apparatus according to claim 5, wherein said heater housing is, in plan view, of substantially square shape.

7. A ceiling fan and heating apparatus according to claim 6, wherein said first heat shield means is disposed on an exterior surface of said heater housing.

8. A ceiling fan and heating apparatus according to claim 7, wherein said second heat shield means is disposed on an interior surface of said heater housing.

9. A ceiling fan and heating apparatus according to claim 8, wherein said heating means comprises an electrical resistance heating element.

10. A ceiling fan and heating apparatus according to claim 9, wherein said heater housing has an upper interior surface and a lower interior surface, said second heat shield means being mounted on said upper interior surface of said heater housing, wherein said electrical resistance heating element is disposed adjacent said upper interior surface of said heater housing and said second heat shield means, and wherein said electrical resistance heating element is spaced vertically from said lower interior surface of said heater housing to create a heated air flow passage therebetween, said at least one air intake port and said at least four air output ports being in communication with said heated air flow passage.

11. A ceiling fan and heating apparatus according to claim 10, wherein said apparatus additionally comprises a fan shaft for rotating said plurality of fan blades, and wherein said at least one air intake port comprises a plurality of air intake openings arranged about said fan shaft.

12. Apparatus for heating and circulating air within a room having a ceiling, said apparatus comprising:

a ceiling fan, said ceiling fan comprising:

a plurality of fan blades;

a motor for rotating said plurality of fan blades; and a pedestal for suspending said plurality of fan blades and said motor from the ceiling such that a vertical gap exists between the ceiling and said plurality of fan blades and said motor;

a heater housing disposed within said vertical gap;

said heater housing having an upper wall and a lower wall;

said upper wall of said heater housing being mounted against the ceiling;

a heat resistant shield positioned within said heater housing and against an interior surface of said upper wall of said heater housing;

an electrical resistance heater element disposed within said heater housing and adjacent said heat resistant shield;

said electrical resistance element being spaced vertically from said lower wall of said heater housing to create a heated air flow passage therebetween;

an additional heat resistant shield positioned outside of said heater housing and against an exterior surface of said lower wall of said heater housing;

said additional heat resistant shield substantially encircling said pedestal;

a plurality of air intake ports passing through said lower wall of said heater housing and from the room into said heated air flow passage;

said plurality of air intake ports being positioned vertically above and radially within the sweep of said plurality of fan blades; and a plurality of air output ports passing through said heater housing and from said heated air flow passage into the room;

said plurality of air output ports being positioned vertically below and radially outside of the sweep of said plurality of fan blades.

13. Apparatus according to claim 12, said apparatus additionally comprising a plurality of air output channels for directing heated air from said heated air passage to said plurality of air output ports, one each of said air output channels extending from said interior of said heater housing to one each of said air output ports.

14. A ceiling fan and heating apparatus for heating and circulating air within a room having a ceiling, said ceiling fan and heating apparatus comprising:

a heater housing for attachment to the ceiling of the room;

said heater housing is, in plan view, of substantially rectangular shape, and wherein said at least four air output ports are disposed at the four corners of said rectangular shape;

a heating means disposed within said heater housing for heating air passing through said heater housing;

a plurality of fan blades disposed vertically below said heater housing;

a motor means for rotating said plurality of fan blades;

at least one air intake port for transferring air from within the room into said heater housing;

said at least one air intake port being disposed above said plurality of fan blades;

at least one air output port for transferring air from within said heater housing into the room;

said at least one air output port being disposed vertically below said plurality of fan blades;

said at least one air output port comprises at least four air output ports, said at least four air output ports being spaced about said heater housing, and each of said at least four air output ports comprising an air output channel extending substantially vertically downward from said heater housing to a point substantially vertically below and substantially radially outside of the sweep of said plurality of fan blades;

said at least four air output ports are spaced equally about said heater housing;

a first heat shield means for protecting said heater housing from heat produced by said heating means;

a second heat shield means for protecting the ceiling of the room from heat produced by said heating means;

said first heat shield means comprises a first layer of a heat resistant material disposed on said heater housing adjacent said plurality of fan blades; and said second heat shield means comprises a second layer of a heat resistant material disposed on said heater housing adjacent the ceiling of the room.

* * * * *